US005291254A

United States Patent [19]

Shimada et al.

[11] Patent Number: 5,291,254

[45] Date of Patent: Mar. 1, 1994

[54] ELECTROPHOTOGRAPHIC RECORDING APPARATUS

[75] Inventors: Akira Shimada; Isamu Terashima, both of Hitachi; Tomoji Kitagishi, Ibaraki; Kazuhiro Wakamatsu, Hitachi; Masahiko Saito, Kitaibaraki, all of Japan

[73] Assignee: Hitachi, Ltd., Tokyo, Japan

[21] Appl. No.: 868,871

[22] Filed: Apr. 16, 1992

[30] Foreign Application Priority Data

| | | | |
|---|---|---|---|
| Apr. 18, 1991 | [JP] | Japan | 3-086533 |
| May 10, 1991 | [JP] | Japan | 3-105524 |
| Aug. 30, 1991 | [JP] | Japan | 3-219598 |

[51] Int. Cl.[5] ..... G03G 15/16

[52] U.S. Cl. ..... 355/275; 355/271; 355/272; 355/274

[58] Field of Search ..... 355/271-277, 355/280-281, 326, 327, 200, 210

[56] References Cited

U.S. PATENT DOCUMENTS

| | | | |
|---|---|---|---|
| 3,838,919 | 10/1974 | Takahashi | 355/271 X |
| 4,341,455 | 7/1982 | Fedder | 355/274 |
| 4,348,098 | 9/1982 | Koizumi | 355/274 |
| 4,607,940 | 8/1986 | Quang | 355/268 |
| 4,896,192 | 1/1990 | Kinoshita | 355/271 X |
| 4,931,839 | 6/1990 | Tompkins et al. | 355/277 |
| 5,001,516 | 3/1991 | Maruyama et al. | 355/202 |
| 5,010,370 | 4/1991 | Araya et al. | 355/271 X |
| 5,040,028 | 8/1991 | Kamimura et al. | 355/275 |
| 5,041,878 | 8/1991 | Takai et al. | 355/273 |
| 5,053,827 | 10/1991 | Tompkins et al. | 355/271 |
| 5,070,370 | 12/1991 | Bellis | 355/271 |
| 5,084,735 | 1/1992 | Rimai et al. | 355/271 |

FOREIGN PATENT DOCUMENTS

| | | | |
|---|---|---|---|
| 0050474 | 3/1984 | Japan . | |
| 0125765 | 7/1984 | Japan . | |
| 0256976 | 10/1988 | Japan | 355/274 |
| 0161369 | 6/1989 | Japan | 355/210 |
| 502062 | 7/1989 | Japan . | |
| 0288870 | 11/1989 | Japan . | |
| 0212870 | 8/1990 | Japan . | |
| 0125163 | 5/1991 | Japan | 355/210 |
| 8501804 | 4/1985 | World Int. Prop. O. | 355/274 |

OTHER PUBLICATIONS

*Patent Abstracts of Japan*; Appl. Pub. No. 59-050474; Pub. Date Mar. 23, 1984; Gp. P287; Kiyoshi, K et al.; "Recorder".

*Patent Abstracts of Japan*; Appl. Pub. No. 57-195258; Pub. Date Nov. 30, 1982; Gp. P178; Kenya, K; "Electrostatic Recorder".

*Patent Abstracts of Japan;* Appl. Pub. No. 63-311263; Pub. Date Dec. 20, 1988; Gp. P855; Takahiro, N et al.; "Intermediate Transfer Body".

*Primary Examiner*—Matthew S. Smith

*Attorney, Agent, or Firm*—Antonelli, Terry, Stout & Kraus

[57] ABSTRACT

In an electrophotographic recording apparatus, toner images of different colors formed on a photosensitive belt are transferred in overlapping fashion to an intermediate transfer drum to form a color toner image and the color toner image is transferred to a secondary recording medium by means of a transfer unit and then fixed. The intermediate transfer drum includes an electrically conductive drum substrate and a dielectric layer whose resistance is adjusted to a predetermined range, and the drum substrate is connected to earth potential so that setting of an electric field for toner image transfer from the photosensitive belt may not interfere with setting of an electric field for toner image transfer by the transfer unit. Efficiencies of transfer at the two transfer sections can be improved to provide a color image of high quality and the apparatus can be reduced in size.

10 Claims, 11 Drawing Sheets

ELECTROPHOTOGRAPHIC RECORDING APPARATUS

BACKGROUND OF THE INVENTION

The present invention relates to electrophotographic recording apparatus such as copiers and laser printers and more particularly to an electrophotographic recording apparatus suitable for color image printing.

In the past, an electrophotographic recording apparatus such as a copier and a laser printer produces a print through an electrophotographic process in which an electrostatic latent image is formed on a primary recording medium such as a photosensitive drum, the latent image is converted into a toner image through development using a developer made of toner or a mixture of toner and carrier, and the toner image is transferred to a secondary recording medium such as a paper or an OHP sheet and is then fixed.

The color electrophotographic recording apparatus for producing a two-color or polychromatic image or a full color image by synthesizing (super-imposing) toner images of different colors formed on the basis of signals obtained by color-separating a copy paper or signals representative of information about components of color of a color image, which signals are obtained by decomposing the color and used to form the color image, uses a photosensitive member, for example, a photosensitive drum or a photosensitive belt as a primary recording medium and is classified into the type wherein toner images of different colors are formed on the photosensitive member in overlapping fashion, the type wherein toner images of different colors formed sequentially on a single photosensitive member are transferred sequentially in overlapping fashion to a secondary recording medium wound round a transfer drum so as to be synthesized, the type wherein toner images of different colors formed sequentially on a single photosensitive member are transferred in overlapping fashion to an intermediate transfer member so as to be synthesized and thereafter transferred to a secondary recording member, and the type wherein toner image forming process means such as photosensitive members and developing units are provided by the same number as that of color separations and toner images of different colors formed on the photosensitive members are transferred sequentially in overlapping fashion to a secondary recording medium so as to be synthesized.

Of them, the type wherein toner images of different colors are formed on the photosensitive member are transferred to the intermediate transfer member in overlapping fashion to provide a color toner image and thus obtained color toner image is transferred to the secondary recording medium such as an OHP sheet is advantageous in that the apparatus can be compact because means for transferring toner images of different colors in overlapping fashion with high accuracies can be constructed relatively easily.

Electrophotographic techniques as above are disclosed in Japanese Patent Application Laid-open Nos. JP-A-1-502062, JP-A-59-50474, JP-A-59-125765, JP-A-1-288870, and JP-A-2-212870.

For example, in a color copier disclosed in the aforementioned Japanese Patent Application Laid-open No. JP-A-1-502062, toner images of a plurality of different colors sequentially formed on a photosensitive belt are transferred in overlapping fashion to an intermediate transfer drum to produce a color toner image and thus produced color toner image is transferred to a recording paper and then fixed; and in a recording apparatus disclosed in the aforementioned Japanese Patent Application Laid-open No. JP-A-59-50474, a toner image formed on a photosensitive drum is transferred electrostatically to an adhesive intermediate transfer member and thereafter press fitted to a recording paper so as to transferred and fixed thereto through heating.

In the color electrophotographic recording apparatus as above, the transfer of toner image is carried out plural times and it is necessary that raising transfer efficiency in each transfer process be contrived. If force necessary for the toner image to be adhered to the intermediate transfer member is increased in order to increase the efficiency of transfer of toner image from the photosensitive member to the intermediate transfer member, then the toner image will hardly separate from the intermediate transfer member, making it difficult to raise the efficiency of transfer of the toner image from the intermediate transfer member to the secondary recording medium.

To increase the transfer efficiency in both the transfer processings, potential gradient at the two transfer sections has to be adjusted but when potential adjustment are carried out locally within the same intermediate transfer member at a time, mutual interference takes place to make achievement of optimum adjustments of the two transfer sections difficult and the construction complicated, thus causing a bottleneck in designing a compact apparatus.

Further, if upon transfer of a toner image from the intermediate transfer member to the secondary recording medium the transfer charge remains on the secondary recording medium then the secondary recording medium will be adsorbed electrostatically to the intermediate transfer member and disadvantageously wound thereround. Generally, discharge means is adapted to prevent this problem but it is affected by the potential of the intermediate transfer member, making it difficult to reduce the electrostatic adsorptive force.

In the apparatus which employs the heating transfer method with a view of improving the efficiency of transfer from the intermediate transfer member to the secondary recording medium, the intermediate transfer member is also heated and heat generated therein is transferred to the photosensitive member and therefore both the members are required to be heat-resisting. Especially, preparation of a heat-resisting photosensitive member faces much difficulties and is unpractical.

In addition, facilitation of developing unit exchange working and toner replenishment working is not taken into account and besides facilitation of working of processing a jam which would take place in the paper feed mechanism for conveying the secondary recording medium and maintenance working for various rollers and fixing unit is not taken into full consideration.

SUMMARY OF THE INVENTION

The present invention intends to cope with the above problems and its object is to realize a practical electrophotographic recording apparatus which can provide high transfer efficiencies at the fist and second transfer processes and suitable for color image printing of high quality.

Another object of the invention is to provide a compact electrophotographic recording apparatus capable of realizing color image printing of high quality.

Still another object of the invention is to facilitate the developing unit exchange working and toner replenishment working as well as the working of processing a jam which would occur in the paper feed mechanism for conveying the secondary recording medium and maintenance working for various roller and fixing unit.

According to one aspect of the embodiment, in an electrophotographic recording apparatus comprising a photosensitive belt applied rotatably, device for forming an electrostatic latent image on the photosensitive belt, developing device for forming a toner image by depositing charged toner on the electrostatic latent image, an intermediate transfer drum to which the toner image is transferred as it rotates synchronously with the photosensitive belt while making contact thereto, and device for transferring the toner image formed on the intermediate transfer drum to a secondary recording medium, the intermediate transfer drum is maintained at earth potential, first transfer device for transferring the toner image from the photosensitive belt to the intermediate transfer drum includes a first bias power supply for applying a first transfer bias voltage which biases the photosensitive belt to potential having the same polarity as charging polarity of the toner relative to earth potential, and second transfer device for transferring the toner image on the intermediate transfer drum to the secondary recording medium includes a second bias power supply for applying a second transfer bias which biases the secondary recording medium to potential having opposite polarity to charging polarity of the toner relative to earth potential.

According to another aspect of the embodiment, in an electrophotographic recording apparatus comprising a photosensitive belt having an electrically conductive layer and a photoconductive layer formed on the surface thereof and applied rotatably, device for sequentially forming a plurality of kinds of electrostatic latent images for different colors on the photosensitive belt, developing device for forming a plurality of toner images by depositing charged toner of colors corresponding to the electrostatic latent images, an intermediate transfer drum to which the plurality of toner images are transferred in overlapping fashion to complete a color toner image as it rotates synchronously with the photosensitive belt while making contact thereto, and device for transferring the color toner image formed on the intermediate transfer drum to a secondary recording medium, the intermediate transfer drum includes a dielectric layer connected to earth potential, first transfer device for transferring the toner image from the photosensitive belt to the intermediate transfer drum includes a first bias power supply for applying a first transfer bias voltage which biases the electrically conductive layer of the photosensitive belt to potential having the same polarity as charging polarity of the toner relative to earth potential, and second transfer device for transferring the toner image on the intermediate transfer drum to a secondary recording medium includes a second bias power supply for applying a second transfer bias which biases the back of the secondary recording medium to potential having opposite polarity to charging polarity of the toner relative to earth potential.

Since the intermediate transfer drum for formation of a color toner image is maintained at earth potential, generation of a transfer electric field at the first transfer section for transferring toner images of different colors from the photosensitive belt to the intermediate transfer drum and generation of a transfer electric field at the second transfer section for transferring the color toner image from the intermediate transfer drum to the secondary recording medium can be effected easily without causing mutual interference, thus placing the two transfer sections in a condition suitable for highly efficient transfer. Also, since the intermediate transfer drum is at stable earth potential at the second transfer section, charge removal for preventing the secondary recording medium from winding round the intermediate transfer drum can be done with ease.

According to still another aspect of the embodiment, in an electrophotographic recording apparatus having an endless photosensitive belt applied rotatably, device for forming electrostatic latent images on the photosensitive belt, a plurality of developing device for forming toner images by depositing charged toner on the electrostatic latent images, an intermediate transfer drum to which the toner images are transferred in overlapping fashion to complete a color toner image as it rotates synchronously with the photosensitive belt while making contact thereto, and device for transferring the color toner image formed on the intermediate transfer drum to a secondary recording medium, the apparatus comprises photosensitive belt rotating and supporting device on which the photosensitive belt is applied in the form of a substantial triangle to form a horizontal top surface, developing unit supporting device for supporting the plurality of developing units above the photosensitive belt such that the developing units are detachable from above and oppose the horizontal top surface of the photosensitive belt, an openable top cover for providing a covering above the plurality of developing units, transfer drum supporting device for maintaining the intermediate transfer drum at earth potential, first transfer device for applying a first transfer bias voltage which biases the photosensitive belt to potential having the same polarity as charging polarity of the toner relative to earth potential, and a second bias power supply, provided for second transfer device for transferring the toner images on the intermediate transfer drum to the secondary recording medium, for applying a second transfer bias which biases the second recording medium to potential having opposite polarity to charging polarity of the toner relative to earth potential.

According to still another aspect of the embodiment, in an electrophotographic recording apparatus having an endless photosensitive belt applied rotatably, device for forming electrostatic latent images on the photosensitive belt, a plurality of developing units for forming toner images by depositing charged toner on the electrostatic latent image, an intermediate transfer drum to which the toner images are transferred as it rotates synchronously with the photosensitive belt while making contact thereto, and device for transferring the toner images formed on the intermediate transfer drum to a secondary recording medium, the apparatus comprises photosensitive belt rotating and supporting device on which the photosensitive belt is applied in the form of a substantial triangle to form a substantially horizontal top surface, developing unit supporting device for supporting the plurality of developing units above the photosensitive belt such that the developing units are detachable from above and oppose the horizontal top surface of the photosensitive belt, an openable top cover for providing a covering above the plurality of developing units, transfer drum supporting device for maintaining the intermediate transfer drum at earth potential and supporting it laterally of the photosensitive belt so that the intermediate transfer drum may contact a substantially vertical surface of the photosensitive belt, first transfer device for applying a first transfer bias voltage which biases the photosensitive belt to potential having the same polarity as charging polarity of the toner relative to earth potential, second transfer device supported laterally of the intermediate transfer drum away from the photosensitive belt and interiorly of a side cover and applied with a second transfer bias voltage which biases the secondary recording medium to potential having opposite polarity to charging polarity of the toner relative to earth potential, and support device for openably supporting the side cover.

In the electrophotographic recording apparatus having the above construction, developing unit exchange and toner replenishment can be facilitated by opening the top cover and processing a jam occurring in the paper feed mechanism for conveying the secondary recording medium and maintenance for various rollers and fixing unit can be facilitated.

DESCRIPTION OF THE PREFERRED EMBODIMENTS

The invention is now described by way of example with reference to the accompanying drawings.

Embodiment 1

Figure 1:
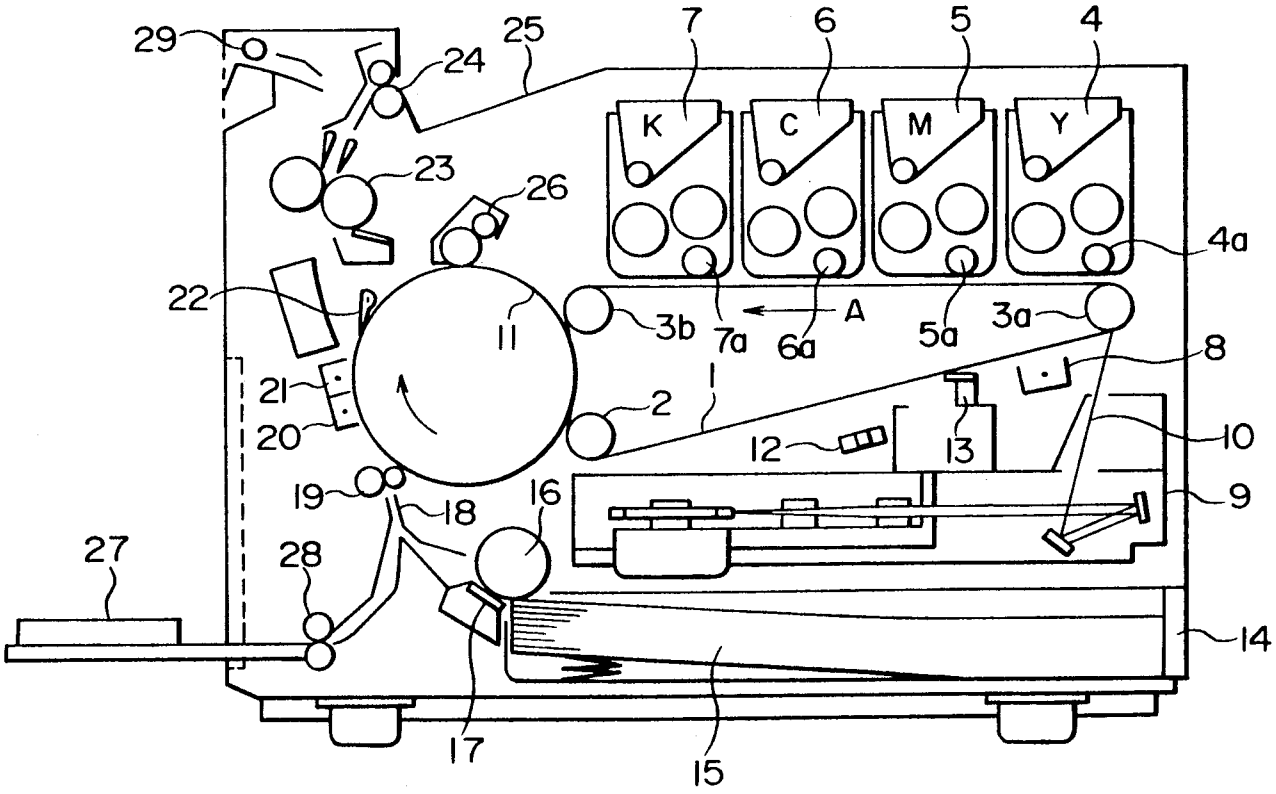
FIG. 1 is a longitudinally sectioned side view of a color electrophotographic recording apparatus according to a first embodiment of the invention.

FIG. 1 shows a color electrophotographic recording apparatus of the invention Used as a primary recording medium formed with a toner image through electrophotographic process is a photosensitive belt 1. The photosensitive belt 1 is formed of a substrate of resin such as polyester having its surface coated or evaporated with metal such as aluminum to form an electrically conductive substrate which in turn is overlaid at its outer peripheral surface with an organic photoconductive layer. The photosensitive belt 1 is applied in tension about a belt driving roller 2 and two follower rollers 3*a* and 3*b* which are arranged at apices of a triangle and it is driven by the belt driving roller 2 to rotate in a direction of arrow (direction of mark A in the figure). Disposed above and along the outer peripheral surface of the photosensitive belt 1 are first, second, third and fourth developing units 4, 5, 6 and 7. The first developing unit 4 forms a magnetic brush at a developing roll 4*a* through the use of a developer using toner of yellow color, the second developing unit 5 forms a magnetic brush at a developing roll 5*a* through the use of a developer using toner of magenta color, the third developing unit 6 forms a magnetic brush at a developing roll 6*a* through the use of a developer using toner of cyan color and the fourth developing unit 7 forms a magnetic brush at a developing roll 7*a* through the use of a developer using toner of black color. Any one of the developing units 4, 5, 6 and 7 is so controlled as to be selectively brought into operating state.

The photosensitive belt 1 in rotation is charged uniformly by means of a charger 8 and subsequently exposed to a laser beam 10 generated from a scanning type laser beam 10 generated from a scanning type laser beam exposure unit 9 so as to be formed with an electrostatic latent image The laser beam 10 generated from the laser beam exposure unit 9 is on/off controlled in accordance with an image recording signal. An electrostatic latent image formed through exposure to laser beam 10 which is on/off controlled in accordance with an image recording signal for formation of toner image of yellow color is developed by the first developing unit 4 so as to be converted into a toner image of yellow color. An electrostatic latent image formed through exposure to laser beam 10 which is on/off controlled in accordance with an image recording signal for formation of toner image of magenta color is developed by the second developing unit 5 so as to be converted into a toner image of magenta color. An electrostatic latent image formed through exposure to laser beam 10 which is on/off controlled in accordance with an image recording signal for formation of toner image of cyan color is developed by the third developing unit 6 so as to be converted into a toner image of cyan color, and an electrostatic latent image formed through exposure to laser beam 10 which is on/off controlled in accordance with an image recording signal for formation of toner image of black color is developed by the fourth developing unit 7 so as to be converted into a toner image of black color.

An intermediate transfer drum 11 is so disposed as to rotate while making contact to the photosensitive belt 1 between the driving roller 2 and follower roller 3*b*. The intermediate transfer drum 11 is formed of an electrically conductive substrate overlaid at its outer peripheral surface with a dielectric layer and its contacting section constitutes a first transfer section to which the toner image is transferred electrostatically from the photosensitive belt 1. In order to improve the efficiency of toner image at the first transfer section, the contacting section is required to have a contact width in the direction of rotation which amounts up to 2 mm or more, especially for stable maintenance of high transfer efficiency, 3 mm or more.

The photosensitive belt 1 having passed through the first transfer section is removed of charge by means of an erase unit 12, is initialized by being removed of residual toner by means of a belt cleaning unit 13 and is again charged uniform so as to be used in the electrophotographic process for formation of a toner image of the next color.

In order that a toner image of a different color to be formed subsequently can be transferred to overlap the toner image already transferred to the intermediate transfer drum 11, its formation position is adjusted. This position adjustment is accomplished by controlling the timing for formation of electrostatic latent image.

In full color image printing, the formation of toner image of yellow color, the transfer of yellow toner image, the formation of toner image of magenta color, the transfer of magenta toner image, the formation of toner image of cyan color, the transfer of cyan toner image, the formation of toner image of black color and the transfer of black toner image are carried out.

After a polychrome toner image is formed on the intermediate transfer drum 11 (a toner image of a color to be superimposed finally is being formed on the photosensitive belt 1 or being transferred from photosensitive belt 1 to intermediate transfer drum 11), secondary recording medium 15 such as recording papers or OHP sheets stored in a feeding paper cassette 14 are separated sheet by sheet by means of a paper feeding roller 16 and a separator 17 and conveyed to resist rollers 19 through a paper conveying path 18. The resist rollers 19 adjust the timing for conveying a secondary recording medium 15 such that the secondary recording medium 15 is brought into register with the toner image on the intermediate transfer drum 11 at a second transfer section.

Provided at the second transfer section is a transfer unit 20 and a discharger 21 which cooperate with each other to transfer the toner image on the intermediate transfer drum 11 to the secondary recording medium 15 under the application of electrostatic force. As the secondary recording medium 15 comes in contact with the intermediate drum 11, the transfer unit 20 applies to the back of the secondary recording medium 15 a DC corona charge which generates electrostatic force for toner transfer. In order to reduce electrostatic adsorptive force due to the charge when the secondary recording medium 15 with the transferred toner image is peeled off from the intermediate transfer drum 11, the discharger 21 generates an AC corona discharge which neutralizes and removes the charge on the secondary recording medium 15. A separation pawl 22 is adapted to steadily peel off the secondary recording medium 15 from the intermediate transfer drum 11.

A fixing unit 23 fixes the toner image to the secondary recording medium 15 and a paper discharge roller 24 discharges the secondary recording medium 15 with the fixed toner image to a paper discharge tray 25.

A drum cleaning unit 26 for leaning the intermediate transfer drum 11 is disposed accessibly to the intermediate transfer drum 11. During the procedure of forming a color toner image by transferring toner images of different colors to the intermediate transfer drum 11, the drum cleaning unit 26 is so operated as to be spaced apart from the intermediate transfer drum 11 but after completion of transfer process, it is brought into contact with the intermediate transfer drum 11 to remove toner remaining thereon.

In the electrophotographic apparatus of the present embodiment, a secondary recording medium 15 can be fed from a hand-off tray 27 and conveyed to the resist rollers 19 by means of paper feeding rollers 28, so that the secondary recording medium 15 can be printed with a color image in a similar manner.

Further, by changing the paper discharge direction of the secondary recording medium 15 having passed through the fixing unit 23 toward a paper discharge roller 29, the secondary recording medium 15 can be discharged to an external tray (not shown).

Figure 2:
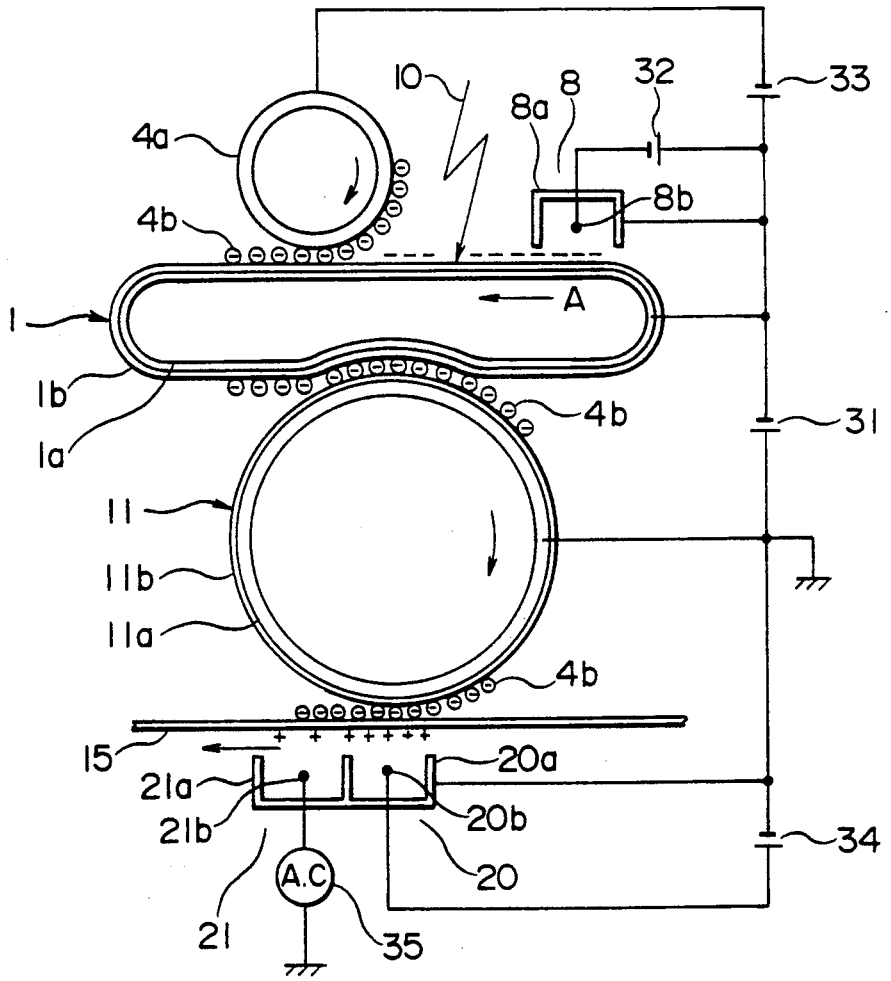
FIG. 2 is an electrical circuit diagram for application of voltages which set potential values of component parts of the color electrophotographic recording apparatus shown in FIG. 1.

Potential setting to component parts which is suitable for execution of electrophotographic process in this electrophotographic recording apparatus is now described in detail. FIG. 2 is an electrical circuit diagram for applying predetermined values of potential to main component parts participating in the electrophotographic process. Exemplified as the developing unit is the first developing unit 4 using yellow toner.

The intermediate transfer drum 11 is formed of an electrically conductive drum substrate 11*a* of aluminum having its surface overlaid with a dielectric layer 11*b* whose resistance is adjusted to a predetermined value, and the drum substrate 11*a* is connected to earth potential. The dielectric layer 11*b* is made of polycarbonate in which electrically conductive metal such as for example carbon black or aluminum is dispersed to adjust the resistance. Preferably, the resistance of the dielectric layer 11*b* approximates $10^7$ to $10^{11}$ Ωcm. With the resistance being higher, the surface of the intermediate transfer drum 11 will be charged up to degrade the efficiency of transfer of toner images which are transferred in overlapping fashion. Experiments conducted by the present inventors demonstrated that for prevention of the charge-up, the resistance of the dielectric layer 11*b* was required to be less than $10^{11}$ Ωcm. With the resistance of the dielectric layer 11*b* being excessively lower, transfer electric field enough to transfer a color toner image formed on the intermediate transfer drum 11 to the secondary recording medium 15 cannot be obtained, thus degrading the transfer efficiency. The lower limit proved to be about $10^7$ Ωcm. Accordingly, it is preferable that the dielectric layer 11*b* have a resistance which is from $10^7$ to $10^{11}$ Ωcm.

Figure 3:
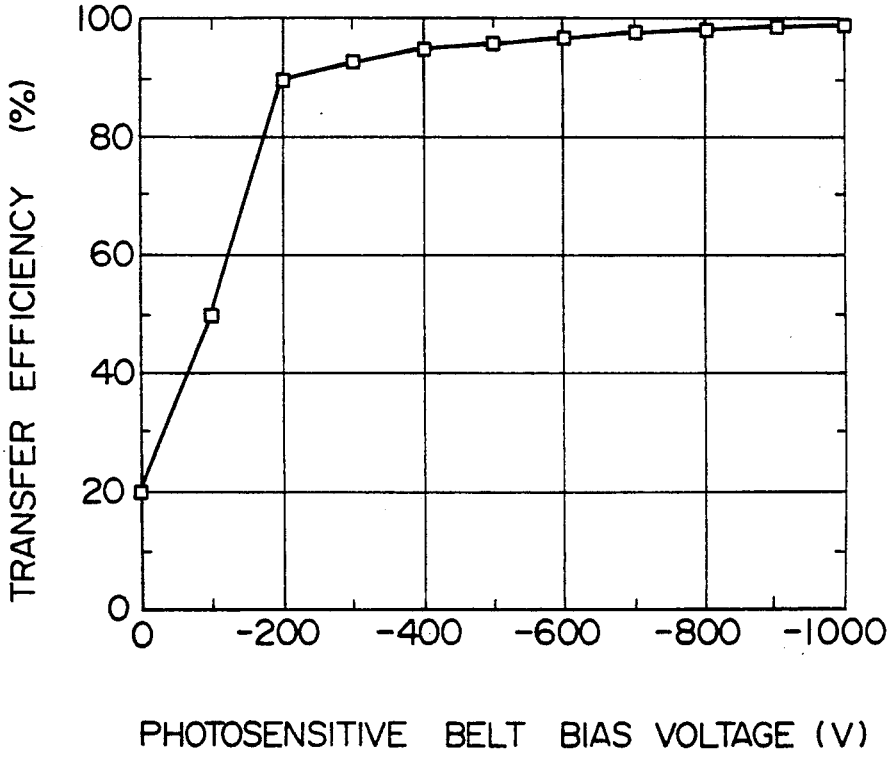
FIG. 3 is a graph showing the relation between photosensitive member bias voltage and efficiency of toner transfer from the photosensitive belt to the intermediate transfer drum.

As described previously, the photosensitive belt 1 is formed of a substrate of resin such as polyester having on its surface an electrically conductive layer formed by coating or evaporating metal such as aluminum to form a belt substrate 1*a*, on which an organic photoconductive layer 1*b* is formed. The photosensitive belt 1 is applied in tension by being insulated from surroundings and the electrically conductive layer standing for the belt substrate 1*a* is connected to a first bias power supply 31 so as to be applied with such a bias voltage that makes potential of the photosensitive belt 1 negative relative to earth potential. FIG. 3 shows the relation of the transfer efficiency to the photosensitive belt bias voltage obtained when a toner image formed of negatively charged toner is transferred from the photosensitive belt 1 to the intermediate transfer drum 11. To ensure a high transfer efficiency of 80% or more, the bias voltage applied to the photosensitive belt 1 falls within a range from −200 to −1000 V, preferably, from −300 to −600 V.

An electrically conductive discharge case 8a of the charger 8 adapted to charge the surface of photosensitive belt 1 uniformly is so connected as to have the same potential as that of the belt substrate 1a of photosensitive belt 1 and a discharge wire 8b is connected to a charger high voltage power supply 32 so that a voltage of about −5 kV relative to the belt substrate 1a may be applied to the discharge wire 8b. As the photosensitive belt 1 rotates in the direction of arrow A, it is charged or electrified uniformly under to have surface potential which is about −600 to −800 V relative to potential of the belt substrate 1a. For example, when the bias voltage of the photosensitive belt 1 is −400 V, the surface potential of the photosensitive belt 1 is about −1000 V to −1200 V.

As the uniformly charged or electrified photosensitive belt 1 is exposed to laser beam 10, potential at a portion irradiated with the laser beam 10 is decreased, relative to the potential of the belt substrate 1a, to about −100 V while potential at a portion not irradiated with the laser beam 10 being maintained at about −600 to −800 V, thus forming an electrostatic latent image. When the first developing unit 4, for example, is operated to develop this electrostatic latent image, a magnetic brush of developer formed on the developing roll 4a made of electrically conductive metal such as aluminum acts on the photosensitive belt 1 to develop the electrostatic latent image. Negatively charged toner 4b is deposited to the portion irradiated with the laser beam 10 and lowered in potential. Therefore, the developing unit 4 is insulated from surroundings and grounded and the developing roll 4a is connected to a developing bias power supply 33 so as to be applied therefrom with developing bias voltage which is about −400 to −600 V relative to the photosensitive belt 1. Similar developing bias potential is applied to each of the second to fourth developing units 5 to 7.

In order that monochromatic toner images thus formed on the photosensitive belt 1 are synthesized to complete a color toner image, the toner images of different colors are transferred to the intermediate transfer drum 11 in overlapping fashion. In monochrome printing, however, transfer of toner images to the intermediate transfer drum 11 is not carried out in overlapping fashion.

At the first transfer section where the photosensitive belt 1 and intermediate transfer drum 11 rotate making contact to each other, the electrically conductive belt substrate 1a of photosensitive belt 1 is biased to, for example, −400 V by means of the photosensitive member bias power supply 31 Accordingly, in the grounded electrically conductive drum substrate 11a of intermediate transfer drum 11, positive charge is induced at its region facing the photosensitive belt 1 and the negative toner image is attracted by the charge to be electrostatically transferred at high efficiency from the photosensitive belt 1 to the intermediate transfer drum 11. While the intermediate transfer drum 11 is rotated repetitively, toner images of different colors formed on the photosensitive belt 1 are sequentially transferred in overlapping fashion and synthesized to complete a color toner image.

In order to transfer the color toner image thus synthesized on the intermediate transfer drum 11 to a secondary recording medium 15, the secondary recording medium 15 is fed to the second transfer section At the secondary transfer section, the transfer unit 20 generates a corona discharge, so that charge for electrostatic transfer is applied to the back of the secondary recording medium 15. An electrically conductive discharge case 20a of the transfer unit 20 is so connected as to have the same earth potential as the intermediate transfer drum 11 and a discharge wire 20b is connected to a transfer unit high voltage power supply 34, so that the discharge wire is applied with about 4 to 6 kV relative to the intermediate transfer drum 11 to apply a corona discharge of opposite polarity to that of the toner image to the back of the secondary recording medium 15.

The electrically conductive drum substrate 11a of the intermediate transfer drum 11 is strongly electrified corresponding to the potential of the photosensitive belt 1 at the first transfer section where the image is received from the photosensitive belt 1 but as the electrically conductive drum substrate 11a runs away from the first transfer section, its charge amount is decreased to an induced amount due to charge of the toner image. Then, as the second transfer section comes round with which the secondary recording medium 15 is brought into register and positive charge for electrostatic transfer is applied to the back of the secondary recording medium 15, negative charge induced by the electrostatic transfer charge is predominantly generated in the electrically conductive drum substrate 11a of the intermediate transfer drum 11. As a result, the negatively charged toner image becomes prone to peel off from the intermediate transfer drum 11 and is also attracted by the electrostatic transfer charge applied to the back of the secondary recording medium 15, thereby being transferred electrostatically to the secondary recording medium 15 at high efficiency.

In parallel with part of the transfer of the toner image from intermediate transfer drum 11 to secondary recording medium 15 at the second transfer section, the process of forming on the photosensitive belt 1 a toner image to be superimposed finally and the process of transferring the toner image from photosensitive belt 1 to intermediate transfer drum 11 at the first transfer section proceed. However, since the electrically conductive drum substrate 11a of intermediate transfer drum 11 is grounded, an amount of charge corresponding to the potential of the photosensitive belt 1 is induced at the first transfer section and an amount of charge corresponding to the potential at the back of the secondary recording medium 15 is induced at the second transfer section, thereby ensuring that toner image transfer free from mutual interference can be carried out.

Charge for transfer applied to the secondary recording medium 15 also acts to cause the secondary recording medium 15 to be adsorbed to the intermediate transfer drum 11. Accordingly, upon separation of the secondary recording medium 15 with the transferred toner image from the intermediate transfer drum 11, transfer charge remaining on the back of the secondary recording medium 15 must be removed. The discharger 21 generates an AC corona discharge for neutralizing and removing the residual transfer charge. An electrically conductive discharge case 21a of the discharger 21 is connected to earth potential and a discharge wire 21b is connected to an AC high voltage power supply 35. Since the intermediate transfer drum 11 is connected to earth potential, the neutralization (removal) of transfer charge can be effected stably by the AC corona discharge generated by the discharger 21 to steadily prevent the secondary recording medium 15 from winding round the intermediate transfer drum 11. Through color image pointing conducted with the color electrophotographic recording apparatus constructed as above, excellent toner image transfer can be effected in toner transfer process at the first and second transfer sections even when both the processes are carried out simultaneously and loss of transfer does not take place at a portion where toner layers overlap and at lie contour, thus producing a color image of high quality. Also, in the thus produced high-quality color image, the amount of misregistration of color toner images can be reduced and transfer disturbance under the influence of the discharger 21 can be avoided. Further, peeling-off of the secondary recording drum 15 from the intermediate transfer drum 11 can be done in good order to prevent the secondary recording medium 15 from winding round the intermediate transfer drum 11, thus eliminating the occurrence of a jam.

Embodiment 2

Figure 4:
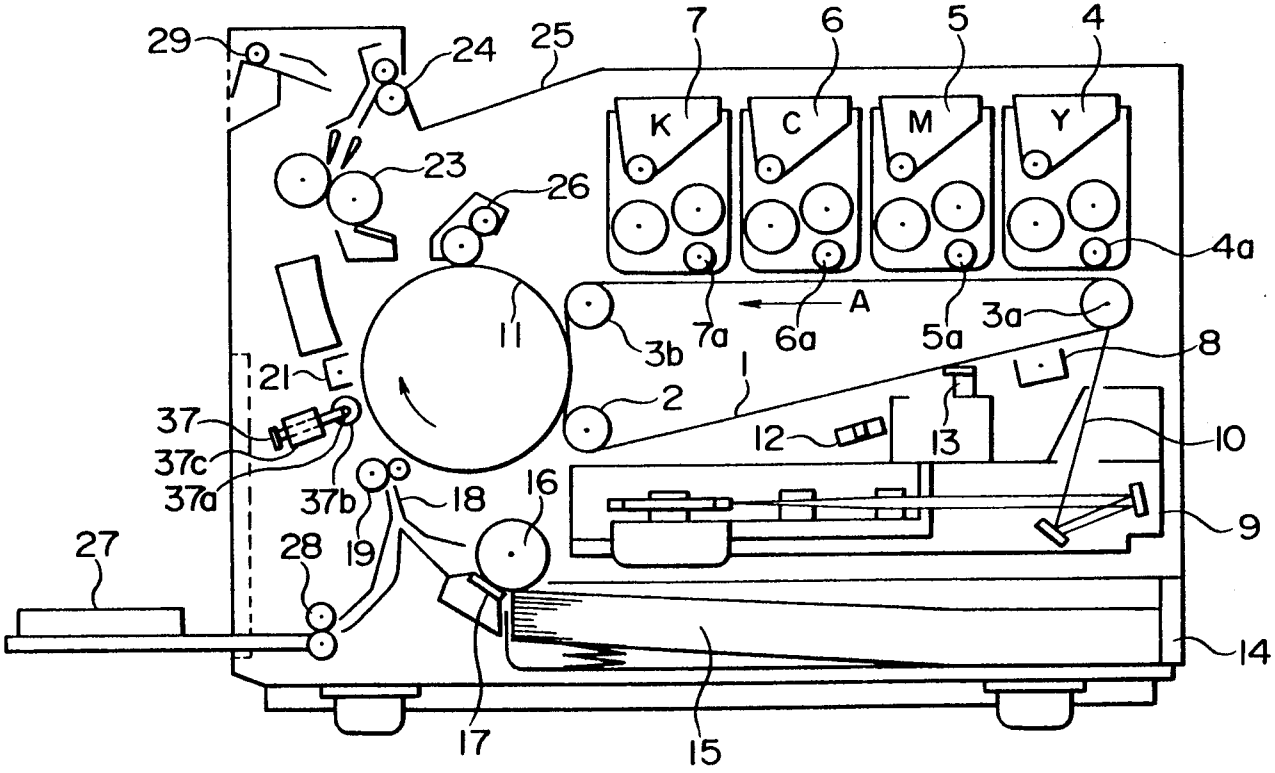
FIG. 4 is a longitudinally sectioned side view of a color electrophotographic recording apparatus according to a second embodiment of the invention.

FIG. 4 shows a color electrophotographic recording apparatus according to another embodiment of the invention. This color electrophotographic recording apparatus is the same as the apparatus of embodiment 1 with the only exception that a roller transfer unit is used for the second transfer section. The same components as those of embodiment 1 are designated by the same reference numerals and will not be detailed.

Provided at the second transfer section is a roller transfer unit 37 which applies transfer potential to the back of a secondary recording medium 15 while pushing the secondary recording medium 15 against the intermediate transfer drum 11. The roller transfer unit 37 has an electrically conductive metal shaft 37*a*, a resilient roll electrode 37*b* having a predetermined resistance and a solenoid 37*c* for advancing or retreating the roll electrode 37*b*.

The roll electrode 37*b* has a resistance which preferably falls within a range from $10^4$ to $10^9$ Ω measured across its surface and shaft, and in the present embodiment, a roll electrode of $10^7$ Ω is used. As for material, rubber or sponge using polymer resin such as urethane is preferable.

The roll electrode 37*b* is retreated to make a pause during the process of forming a color toner image by transferring toner images of different colors from the photosensitive belt 1 to the intermediate transfer drum 11 but is advanced in synchronism of arrival of a secondary recording medium 15 to push the secondary recording medium 15 against the intermediate transfer drum 11 during the process of transferring a completed color toner image from the intermediate transfer drum 11 to the secondary recording medium 15. Synchronously with this operation, a predetermined transfer bias voltage is applied to the roll electrode 37*b* to generate a transfer electric field for transfer of a toner image on the intermediate transfer drum 11 to the secondary recording medium 15.

The discharger 21 generates an AC corona discharge for removing electric charge charged on the back of the secondary recording medium 15 under the application of the transfer voltage.

Figure 5:
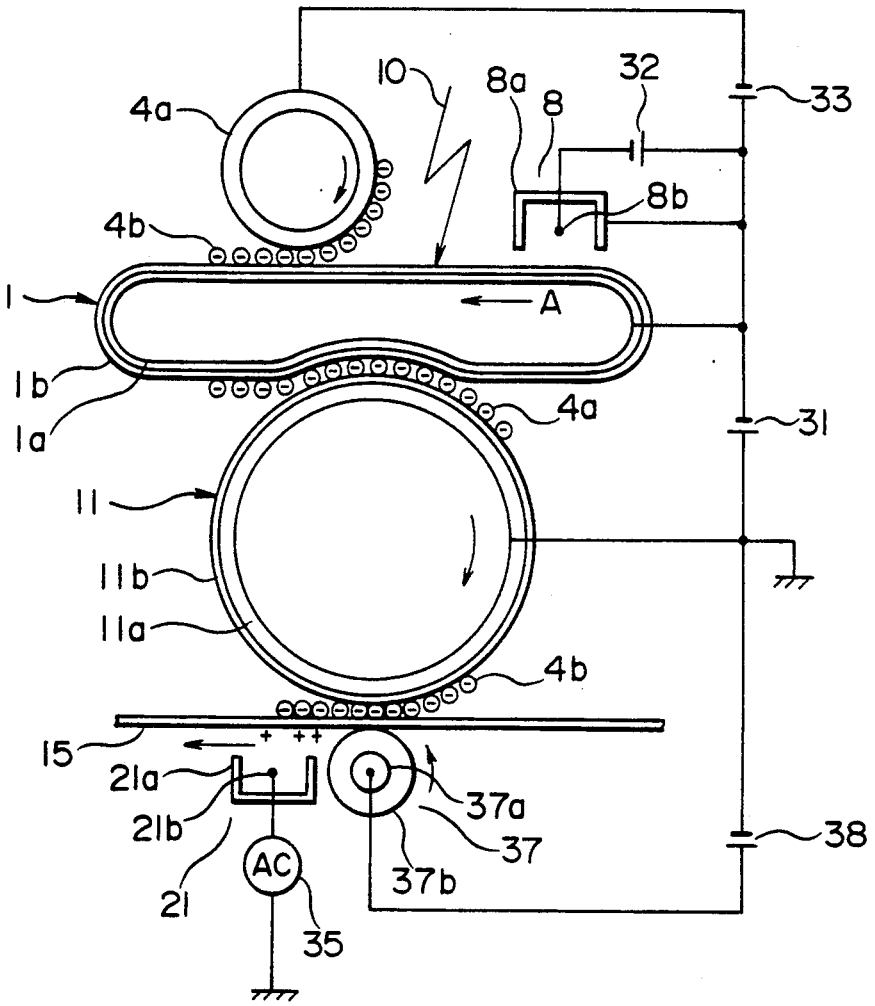
FIG. 5 is an electrical circuit diagram for application of voltages which set potential values of component parts of the color electrophotographic recording apparatus shown in FIG. 4.

Potential setting to component parts which is suitable for execution of electrophotographic process in this electrophotographic recording apparatus is now described in detail with reference to FIG. 5. FIG. 5 is an electrical circuit diagram for applying predetermined values (levels) of potential to main component parts participating in the electrophotographic process. Exemplified as the developing unit is the first developing unit 4 using yellow toner. The same construction as those of embodiment 1 is not detailed.

Figure 6:
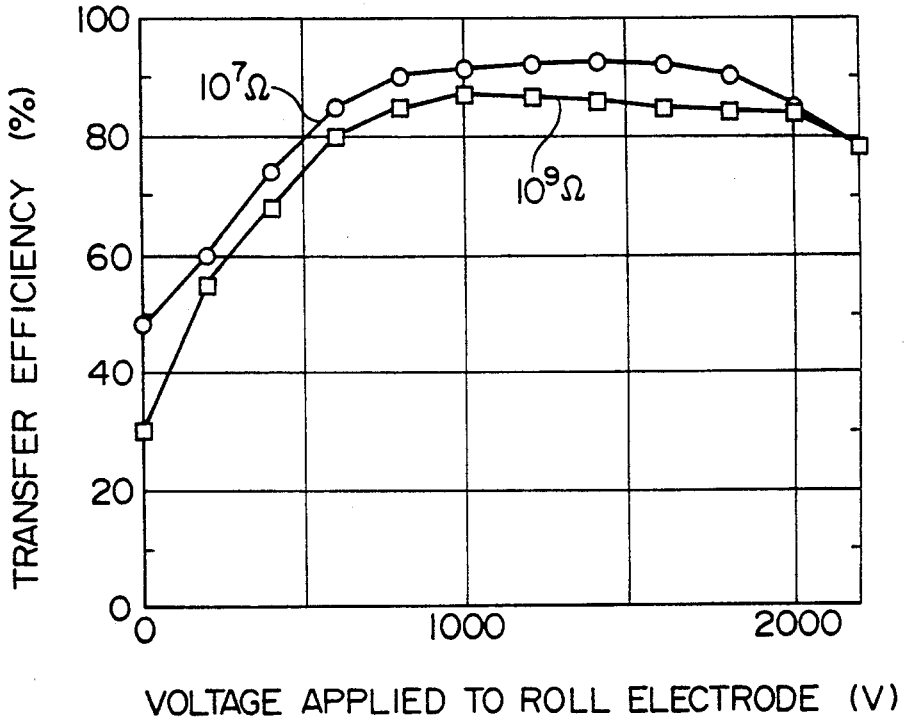
FIG. 6 is a graph showing the relation between voltage applied to the transfer roll and efficiency of toner transfer from the intermediate transfer drum to a paper in the color electrophotographic recording apparatus shown in FIG. 4.

A transfer bias power supply 38 is connected between the metal shaft 37*a* and earth potential in order to apply bias voltage for transfer to the roll electrode 37*b* during the toner image transfer process. The transfer bias power supply 38 biases the roll electrode 37*b* to a transfer potential value (level) which is opposite polarity to charging polarity of toner image and has a potential difference of about 600 to 2000 V relative to earth potential. When roll electrodes 37*b* having resistances of $10^7$ Ω and $10^9$ Ω, respectively, were used, results of measurement of the relation between voltage applied to the roll electrode 37*b* (potential difference relative to earth potential) and transfer efficiency were obtained as shown in FIG. 6. On the basis of the results, a transfer voltage of 1400 V was applied to the metal shaft 37*a* in the present embodiment to ensure a transfer efficiency approximating 90%.

Through color image printing conducted with the electrophotographic recording apparatus, excellent toner image transfer can be effected in toner transfer processe at the first and second transfer sections even when both the processes are carried out simultaneously and loss of transfer does not take place a portion where toner layers overlap and at line contour, thus producing a color image of high quality as in the case of the foregoing embodiment. Also, in the thus produced high-quality color image, the amount of misregistration of color toner images can be reduced and transfer disturbance under the influence of the discharger 21 can be avoided. Further, peeling-off of the secondary recording medium 15 from the intermediate transfer drum 11 can be done in good order to prevent the secondary recording medium 15 from winding round the intermediate transfer drum 11, thus eliminating the occurrence of a jam.

Embodiment 3

Figure 7:
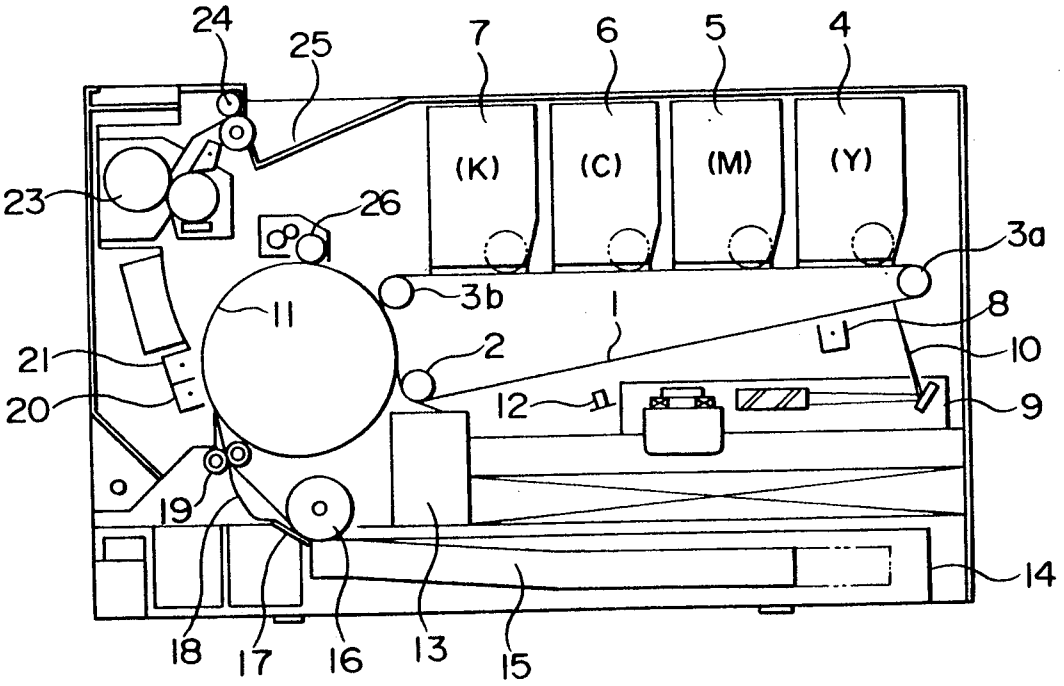
FIG. 7 is a longitudinally sectioned side view of a color electrophotographic recording apparatus according to a third embodiment of the invention.

FIG. 7 shows a color electrophotographic recording apparatus according to still another embodiment of the invention. Structurally, this color electrophotographic recording apparatus differs from the color electrophotographic recording apparatus of embodiment 1 described previously in that a belt cleaning unit 13 is installed at a different site, the hand-off tray 27 and external tray paper discharge roller 29 are removed and a different developing method is employed.

While the developing method in the apparatus of embodiment 1 is an inversion developing method, the color electrophotographic recording apparatus of the present embodiment employs a normal developing method in which toner is deposited to a region where laser beam 10 is not irradiated and electric charge remains. Accordingly, potential values applied to individual components are different from those in embodiment 1 and positively charged toner is used for the developing units 4 to 7. A laser beam exposure unit 9 is reduced in size and the belt cleaning unit 13 is so disposed as to be pushed against the photosensitive belt 1 at the belt driving roller 2 to clean the photosensitive belt 1. The dielectric layer 11*b* of the intermediate transfer drum 11 is made of TEFLON resin containing a dispersed electrically conductive filler so that its resistance may be adjusted to about $10^7$ to $10^{11}$ Ωcm. The surface of the TEFLON resin layer has good lubricity, bringing about an advantage that the cleaning characteristics for toner remaining on the intermediate transfer drum 11 after a toner image is transferred to the secondary recording medium 15 can be improved. The other components are the same as those of the color electrophotographic recording apparatus of embodiment 1 and will not be detailed herein.

Figure 8:
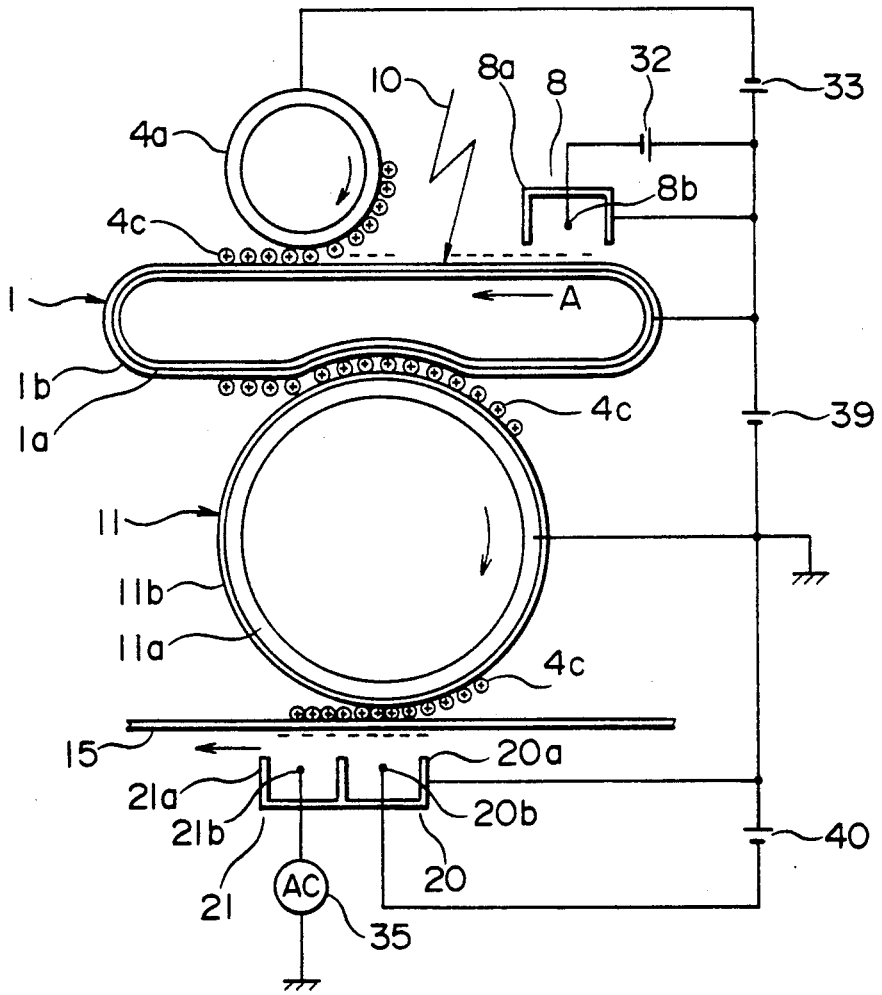
FIG. 8 is an electrical circuit diagram for application of voltages which set potential values of component parts of the color electrophotographic recording apparatus shown in FIG. 7.

FIG. 8 shows an electrical circuit for setting predetermined potential values to main components of the color electrophotographic recording apparatus shown in FIG. 7. A drum substrate 11*a* of the intermediate transfer drum 11 is connected to earth potential which serves as reference potential. A belt substrate 1*a* of the photosensitive belt 1 is connected to a photosensitive member bias power supply 39 in order that positively charged toner 4*c* can be transferred from the photosensitive belt 1 to the intermediate transfer drum 11 and is applied with a bias voltage of positive polarity relative to earth potential. Preferably, the magnitude of this bias voltage may lie within a range from 200 to 1000 V, more preferably, 300 to 600 V relative to earth potential.

An electrically conductive discharge case 8*a* of the charge 8 is so connected as to assume the same potential as that of the belt substrate 1*a* of photosensitive belt 1 and a discharge wire 8*b* of the charger 8 is connected to a charger high voltage power supply 32 so as to be applied with a voltage which is about −5 kV relative to the potential of the belt substrate 1*a*.

When the photosensitive belt 1 is charged electrified by a corona discharge generated from the charger 8 as it rotates in a direction of arrow A in FIG. 8, its surface is uniformly charged or electrified so as to assume a potential value of about −600 to −800 V relative to the potential of the belt substrate 1*a*. For example, when the bias voltage of the photosensitive belt 1 is 400 V, potential at the surface of the photosensitive belt 1 is about −200 to −400 V relative to earth potential.

When the uniformly charged photosensitive belt 1 is exposed to laser beam 10, potential of a portion irradiated with the laser beam 10 is decreased to about −100 V relative to the potential of the belt substrate la while potential of a portion not irradiated with the laser beam is maintained at about −600 to −800 V, with the result that an electrostatic latent image is formed on the surface of the photosensitive belt 1. As a magnetic brush formed at the developing roll 4*a* made of electrically conductive metal such as aluminum brushes the surface of the photosensitive belt 1, toner 4*c* is deposited to the highly charged region (normal development) to form a toner image. The developing roll 4*a* is connected to a developing bias power supply 33 to assume a potential value of about −100 to 400 V relative to the belt substrate la of the photosensitive belt 1.

At the first transfer section where the toner images thus formed on the photosensitive belt 1 are transferred to the intermediate transfer drum 11 in overlapping fashion, because of the electrically conductive belt substrate 1*a* of photosensitive belt 1 biased to 400 V by the photosensitive member bias power supply 39, negative charge is induced in the electrically conductive drum substrate 11*a* and the positive toner image is attracted by this negative charge to be transferred electrostatically from the photosensitive belt 1 to the intermediate transfer drum 11 at high efficiency. While the intermediate transfer drum 11 is rotated repetitively, toner images of different colors formed on the photosensitive belt 1 are sequentially transferred in overlapping fashion and synthesized to complete a color toner image.

In the transfer unit 20 provided at the second transfer section where the toner image thus synthesized on the intermediate transfer drum 11 is transferred to a secondary recording medium 15, an electrically conductive case 20*a* is so connected as to assume earth potential like the intermediate transfer drum 11, and a tungsten wire 20*b* for generation of corona discharge is connected to a transfer unit high voltage power supply 40 so that a corona discharge of opposite polarity to that of the toner image may be applied to the back of the secondary recording medium 15, thus being applied with a voltage of about −5 to −6 kV relative to the intermediate transfer drum 11.

In this color electrophotographic recording apparatus, too, a high-quality color image can be obtained in which the amount of misregistration of color toner images can be reduced and transfer disturbance under the influence of the discharger 21 can be avoided, as in the case of the previously-described color electrophotographic recording apparatus. Further, the efficiency of toner image transfer to the secondary recording medium 15 is also high to reduce the amount of toner remaining on the intermediate transfer drum 11 and peeling-off the secondary recording medium 15 from the intermediate transfer drum surface can be done in good order.

Embodiment 4

Figure 9:
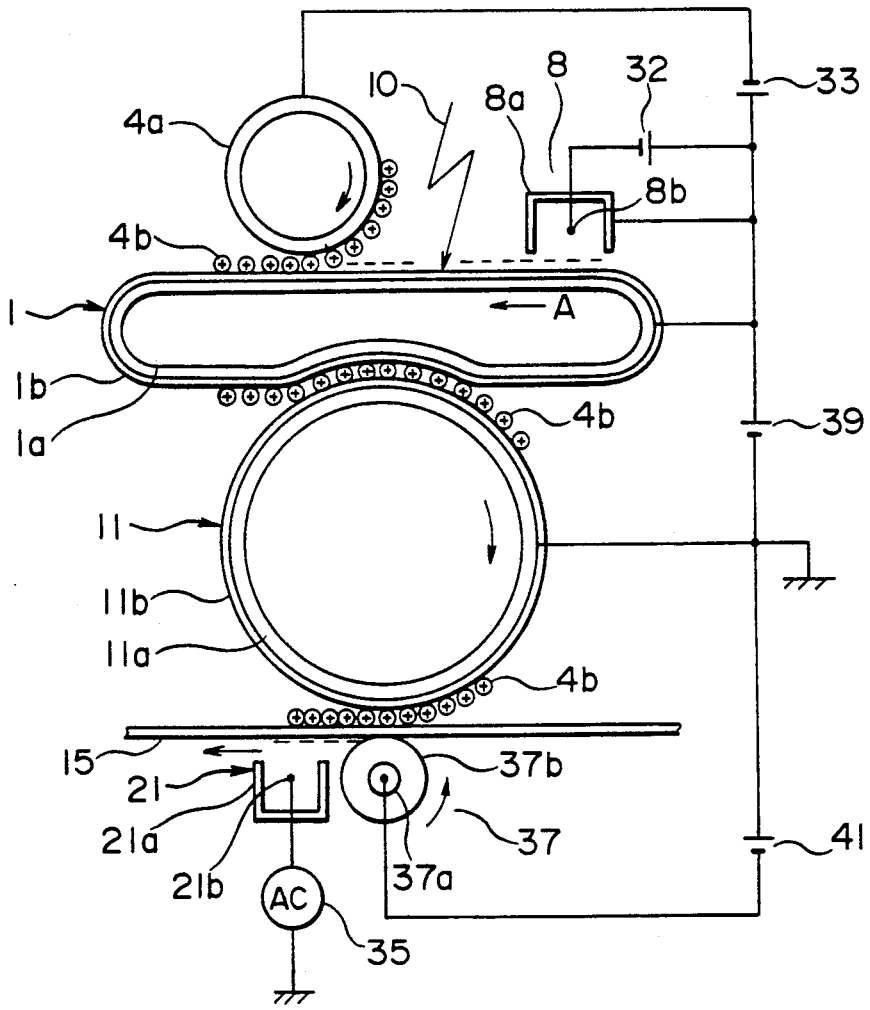
FIG. 9 is an electrical circuit diagram for application of voltages which set potential values of component parts of a color electrophotographic recording apparatus according to a fourth embodiment of the invention.

In a color electrophotographic recording apparatus according to this embodiment, the transfer unit 20 provided at the second transfer section in the previously-described embodiment 3 is replaced with a roller transfer unit 37 and the roller transfer unit 37 used here is structurally identical to the roller transfer unit of the previously-described embodiment 2. FIG. 9 shows electrical connection for setting potential to individual component parts of the apparatus.

Since a toner image on the intermediate transfer drum 11 is charged positively, the roller transfer unit 37 for transfer of toner image to the secondary recording medium 15 is applied with a bias voltage of −600 V to −2000 V from a transfer bias power supply 41.

The present embodiment can attain similar effects to those obtained by the foregoing embodiment.

Embodiment 5

Figure 10:
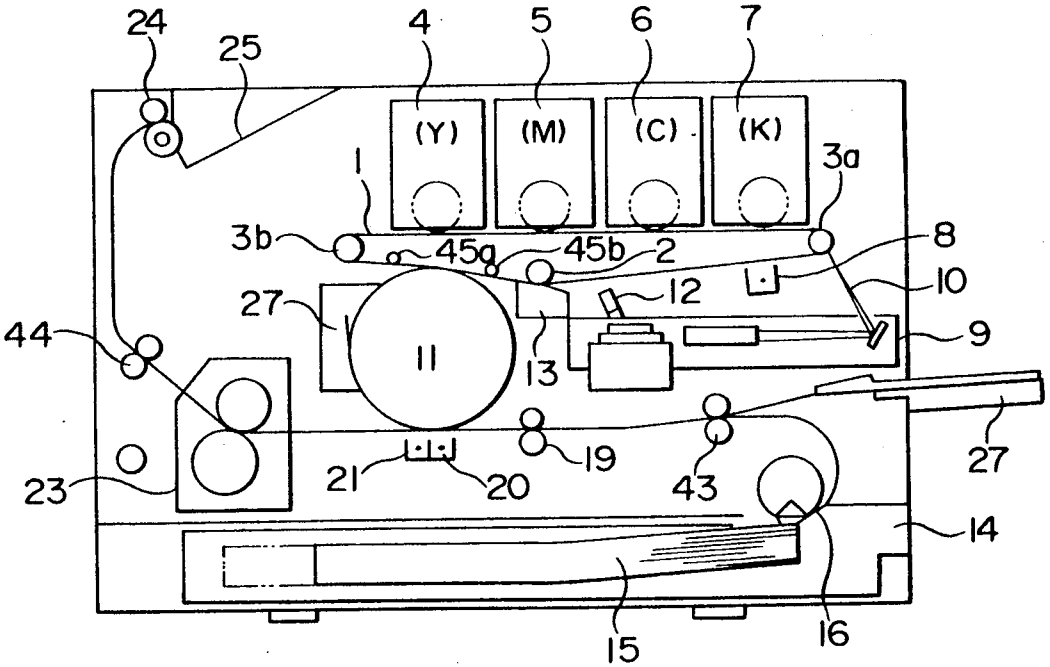
FIG. 10 is a longitudinally sectioned side view of a color electrophotographic recording apparatus according to a fifth embodiment of the invention.

FIG. 10 shows a color electrophotographic recording apparatus according to a further embodiment of the invention. Structurally, this color electrophotographic recording apparatus is essentially identical with the color electrophotographic recording apparatus of the previously-described embodiment 1 with the exception that the manner of applying a photosensitive belt 1 is different, installation sites of an erase unit 12, a belt cleaning unit 13 and a hand-off tray 27 ar changed and convey rollers 43 and 44 are added. The photosensitive belt 1 is mainly applied on a belt driving roller 2 and two convey rollers 3*a* and 3*b* and driven thereby but the contact width with the intermediate transfer drum 11 is adjusted by two pinch rollers 45*a* and 45*b* newly provided. The contact width between the photosensitive belt 1 and intermediate transfer drum 11 is set to 4 mm.

In the present embodiment, the sequence of toner image forming process and the electrical connection for applying bias voltages to the main component parts are the same as those in embodiment 1 but the order of disposition of four developing units 4, 5, 6 and 7 is different The developing method is an inversion developing method in which the developer employed in the developing units 4 to 7 uses negatively charged toner In this color electrophotographic recording apparatus, similar effects to those in the previously-described color electrophotographic recording apparatus can be attained.

Embodiment 6

Figure 11:
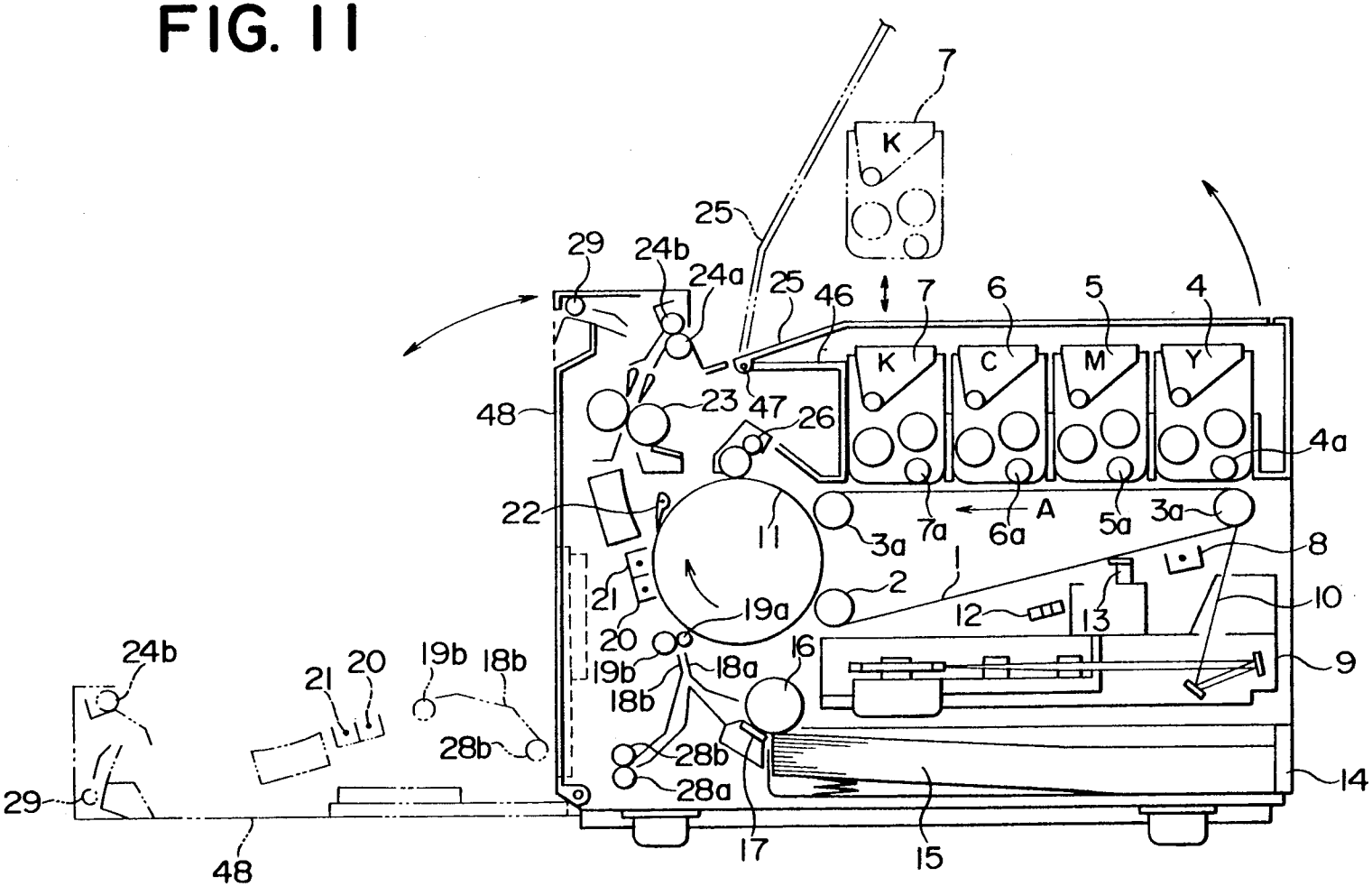
FIG. 11 is a longitudinally sectioned side view of a color electrophotographic recording apparatus according to a sixth embodiment of the invention.

FIG. 11 shows a color electrophotographic recording apparatus according to a further embodiment of the invention. According to the present embodiment, the color electrophotographic recording apparatus is improved on for the purpose of facilitating maintenance working. Component parts common to the first embodiment are designated by like reference numerals and is not detailed.

A paper discharge tray 25 also plays the part of a body top cover and is rotatably supported by a frame 46 through a rotary support shaft 47. With the paper discharge tray opened, tops of the developing units 4 to 7 for different colors are exposed. Each of the developing units 4 to 7 for different colors is detachably mounted on a seat formed on the frame 46 and can be mounted or dismounted through an open space set up above each of the developing units 4 to 7 when the paper discharge tray 25 is opened. This construction is very convenient for exchange working of the developing units 4 to 7 and toner replenishment working.

A paper feed mechanism adapted to feed a secondary recording medium 15 extracted from the feeding paper cassette 14 and then subjected to toner image transfer and fixing, facilitates jam processing and maintenance for various rollers and fixing unit. In order to facilitate maintenance, a side cover 48 covering the paper feed mechanism is rotatably supported by the frame through a rotary support shaft 49. A convey guide **18*b*, a resist roller 19*b*, a transfer unit 20, a discharger 21, a paper feed rollers 24*b* and 29 and a paper feed roller 28*b* which are to be positioned outside of a secondary recording medium path in the paper feed mechanism are mounted interiorly of the side cover 48. Accordingly, with the wide cover 48** opened, most of the paper feed mechanism is opened, thus making it easy to carry out the jam processing and maintenance for various rollers and fixing unit.

We claim:

1. An electrophotographic recording apparatus including a photosensitive belt having an electrically conductive layer and a photoconductive layer formed on the surface thereof and applied rotatably, means for sequentially forming a plurality of kinds of electrostatic latent images for different colors on said photosensitive belt, developing means for forming a plurality of toner images by depositing charged toner of colors corresponding to the electrostatic latent images, an intermediate transfer drum to which said plurality of toner images are transferred in overlapping fashion to complete a color toner image as it rotates synchronously with said photosensitive belt while making contact thereto, and means for transferring the color toner image formed on said intermediate transfer drum to a secondary recording medium, said apparatus comprising:

said intermediate transfer drum including a dielectric layer connected to earth;

first transfer means for transferring the toner images from said photosensitive belt to said intermediate transfer drum including a first bias power supply for applying a first transfer bias voltage which biases said electrically conductive layer of said photosensitive belt to potential having the same polarity as charging polarity of the toner relative to earth potential;

second transfer means for transferring the toner image formed on said intermediate transfer drum to said secondary recording medium including a second bias power supply for applying a second transfer bias which biases the back of said secondary recording medium to potential having opposite polarity to charging polarity of the toner relative to earth potential;

said means for formation of the electrostatic latent images including means for forming on the surface of said photosensitive belt electrostatic latent images by using the second transfer bias potential as reference potential; and said developing means including means for developing the electrostatic latent images by using the second transfer bias potential as reference potential.

2. An electrophotographic recording apparatus according to claim 1 wherein said first transfer bias voltage has a voltage difference of 200 V or more relative to earth potential.

3. An electrophotographic recording apparatus according to claim 1 wherein said second transfer means comprises a corona discharger energized by said second bias power supply to charge on the back of said secondary recording medium an electric charge having opposite polarity to that of the toner.

4. An electrophotographic recording apparatus according to claim 1 wherein said second transfer means comprises a roll electrode energized by said second bias power supply and pushed against the back of said secondary recording medium.

5. An electrophotographic recording apparatus according to claim 4 wherein said roll electrode includes an electrically conductive metal shaft and a resilient layer having a resistance of $10^4$ to $10^9$ Ω.

6. An electrophotographic recording apparatus according to claim 4 wherein said roll electrode includes an electrically conductive metal shaft and a resilient layer having a resistance of $10^4$ to $10^9$ Ω and said second bias power supply applies a bias voltage having a voltage difference of 600 to 2000 V relative to earth potential to said metal shaft.

7. An electrophotographic recording apparatus according to claim 1 wherein said dielectric layer of said intermediate transfer drum has a resistance of $10^7$ to $10^{11}$ Ωcm.

8. An electrophotographic recording apparatus including an endless photosensitive belt applied rotatably, means for forming electrostatic latent images on said photosensitive belt, a plurality of developing units for forming toner images by depositing charged toner on the electrostatic latent images, an intermediate transfer drum to which the toner images are transferred in overlapping fashion to complete a color toner image as it rotates synchronously with said photosensitive belt while making contact thereto, and means for transferring the color toner image formed on said intermediate transfer drum to a secondary recording medium, said apparatus comprising:

photosensitive belt rotating and supporting means on which said photosensitive belt is applied in the form of a substantial triangle to form a horizontal top surface;

developing unit supporting means for supporting said plurality of developing units such that said developing units are detachable from above and oppose said horizontal top surface of said photosensitive belt;

an openable top cover for providing a covering above said plurality of developing units;

transfer drum supporting means for maintaining said intermediate transfer drum at earth potential;

first transfer means for applying a first transfer bias voltage which biases said photosensitive belt to potential having the same polarity as charging polarity of the toner relative to earth potential; and a second bias power supply, provided for second transfer means for transferring the toner image on said intermediate transfer drum to said secondary recording medium, for applying a second transfer bias which biases said second recording medium to potential having opposite polarity to charging polarity of the toner image relative to earth potential.

9. An electrophotographic recording apparatus according to claim 8 wherein said photosensitive belt rotating and supporting means rotatably supports said photosensitive belt applied thereon to form a substantially horizontal top surface, a substantially vertical surface and an inclined surface, and said intermediate transfer drum contacts said photosensitive belt at said substantially vertical surface.

10. An electrophotographic recording apparatus including an endless photosensitive belt applied rotatably, means for forming electrostatic latent images on said photosensitive belt, a plurality of developing units for forming toner images by depositing charged toner on said electrostatic latent images, an intermediate transfer drum to which the toner images are transferred as it rotates synchronously with said photosensitive belt while making contact thereto, and means for transferring the toner images to a secondary recording medium, said apparatus comprising:

photosensitive belt rotating and supporting means on which said photosensitive belt is applied in the form of a substantial triangle to form a substantially horizontal top surface;

developing unit supporting means for supporting said plurality of developing units above said photosensitive belt such that said developing units are detachable from above and oppose said horizontal top surface of said photosensitive belt;

an openable top cover for providing a covering above said plurality of developing units;

transfer drum supporting means for maintaining said intermediate transfer drum at earth potential and supporting it laterally of said photosensitive belt so that said intermediate transfer drum may contact a substantially vertical surface of said photosensitive belt;

first transfer means for applying a first transfer bias voltage which biases said photosensitive belt to potential having the same polarity as charging polarity of the toner relative to earth potential;

second transfer means supported laterally of said intermediate transfer drum away from said photosensitive belt and interiorly of a side cover and applied with a second transfer bias which biases said secondary recording medium to potential having opposite polarity to charging polarity of the toner relative to earth potential; and support means for openably supporting said side cover.

* * * * *